US012410574B2

(12) United States Patent
Jancek et al.

(10) Patent No.: US 12,410,574 B2
(45) Date of Patent: Sep. 9, 2025

(54) GROUND COMPACTION SENSING SYSTEM AND METHOD FOR A WORK MACHINE

(71) Applicant: Deere & Company, Moline, IA (US)

(72) Inventors: Hunter Jancek, Dubuque, IA (US); Randy J. Schamberger, Hazel Green, WI (US); Craig A. Christofferson, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 204 days.

(21) Appl. No.: 17/821,254

(22) Filed: Aug. 22, 2022

(65) Prior Publication Data

US 2024/0060262 A1 Feb. 22, 2024

(51) Int. Cl.

| | |
|---|---|
| ***E02F 3/84*** | (2006.01) |
| ***E02D 3/026*** | (2006.01) |
| ***E02F 9/26*** | (2006.01) |

(52) U.S. Cl.

CPC ..... *E02D 3/026* (2013.01); *E02F 9/262* (2013.01); *E02F 3/841* (2013.01)

(58) Field of Classification Search

CPC ..... E02D 3/026; E02F 9/262; E02F 9/264; E02F 3/845; E02F 3/841; E02F 3/7609

See application file for complete search history.

(56) References Cited

U.S. PATENT DOCUMENTS

| | | | | |
|---|---|---|---|---|
| 9,511,633 | B2 | 12/2016 | Anderson et al. | |
| 9,624,643 | B2 | 4/2017 | Hendron et al. | |
| 10,315,655 | B2 | 6/2019 | Blank et al. | |
| 10,829,901 | B2 | 11/2020 | Wisley et al. | |
| 11,131,614 | B2 | 9/2021 | O'Donnell | |
| 11,180,902 | B2 | 11/2021 | Christofferson et al. | |
| 2005/0183512 | A1* | 8/2005 | Corcoran | E02D 3/026 73/818 |
| 2009/0202109 | A1* | 8/2009 | Clar | E02F 9/261 382/104 |

(Continued)

FOREIGN PATENT DOCUMENTS

| | | | |
|---|---|---|---|
| DE | 102018207706 | A1 | 3/2019 |
| DE | 102019208302 | A1 | 1/2020 |
| DE | 102021208677 | A1 | 3/2022 |

OTHER PUBLICATIONS

German Search Report issued in application No. 102023119348.1 dated Mar. 8, 2024, 08 pages.

*Primary Examiner* — Stephen Holwerda

(57) ABSTRACT

A ground compaction sensing system for a work machine includes a chassis, a ground-engaging mechanism coupled to the chassis, and an attachment movably coupled to the chassis. Multiple sensors are configured to generate a chassis angle signal, an attachment angle signal, an attachment spacing signal, and a location signal. The controller has a non-transitory computer readable medium with a program instruction to grade a surface. The program instructions when executed cause a processor of the controller to receive the aforementioned signals and determine an as-built grade of the surface based on an attachment reference point at a first location of the location signal; and a compaction value when a chassis reference point reaches the first location as the work machine traverses across the surface. The program instructions may then include modifying movement of the attachment based on the compaction value.

14 Claims, 8 Drawing Sheets

(56) References Cited

U.S. PATENT DOCUMENTS

| | | | | |
|---|---|---|---|---|
| 2016/0103051 | A1* | 4/2016 | Corcoran | E01C 3/04 73/32 R |
| 2016/0230367 | A1 | 8/2016 | Hendron et al. | |
| 2016/0251830 | A1* | 9/2016 | Son | F15B 11/028 60/445 |
| 2018/0002882 | A1* | 1/2018 | Stromsoe | E01C 19/266 |
| 2018/0119387 | A1 | 5/2018 | Sherlock | |
| 2018/0179719 | A1 | 6/2018 | Wisley et al. | |
| 2019/0330825 | A1* | 10/2019 | Tanimoto | B60K 35/23 |
| 2021/0010229 | A1* | 1/2021 | Sano | E02F 9/2292 |
| 2021/0134090 | A1 | 5/2021 | Sporrer et al. | |
| 2022/0145584 | A1 | 5/2022 | Fujiwara et al. | |
| 2022/0146391 | A1 | 5/2022 | Von Holst et al. | |

* cited by examiner

GROUND COMPACTION SENSING SYSTEM AND METHOD FOR A WORK MACHINE

TECHNICAL FIELD

The disclosure generally relates to a ground compaction sensing system and method for a work machine.

BACKGROUND

Grading operations with work machines is a specialized phase of the construction process. Proper ground preparation ensures expected outcomes in architectural construction, control of water runoff, road construction, environmental impact and compliance with land grading standards. Current technology enables fine-tuned global positioning systems to accurately track the location of surface creation from a design file with minimal direction from the operator. However, the as-built surfaces derived from the design file assume a 100% compaction of the ground surface, when in reality, many surface cutting and spreading operations may yield some loosely compacted material. This may require additional passes depending on the degree of compaction to meet specification. Alternatively, over compaction may lead to wasted time and fuel. Current methods include spot checking compaction throughout a worksite using an arduous manual process (e.g. using a cone penetrometer). Therein lies an opportunity for improved grading operations by accounting for other influences, such as vehicular traffic, in real-time.

SUMMARY

A ground compaction sensing system and method for a work machine is disclosed. The ground compaction sensing system comprises a chassis, a ground-engaging mechanism coupled to the chassis; an attachment coupled to the chassis, a first sensor, a second sensor, a third sensor, a fourth sensor, and a controller. The first sensor is coupled to the chassis and configured to generate a chassis angle signal indicative of a chassis angle relative to the direction of gravity. The second sensor is coupled to the attachment and configured to generate an attachment angle signal indicative of an attachment angle relative to the direction of gravity. The third sensor is configured to generate an attachment spacing signal wherein a distance between the attachment and the chassis may be derived. The fourth sensor is configured to generate a location signal indicative of a location of one of the chassis and the attachment. The controller has a non-transitory computer readable medium with a program instruction to grade a surface. The program instructions when executed cause a processor of the controller to perform the following steps. In a first step, a processor will receive the chassis angle signal from the first sensor; receive the attachment angle from the second sensor; receive the attachment spacing signal from the third sensor and receive the location signal from the fourth sensor. Next, the processor determines an as-built surface based on the chassis angle signal, the attachment angle signal, the attachment spacing signal when a chassis reference point reaches the first location as the work machine traverses across the surface. Then, the processor modifies movement of the attachment based on the compaction value.

The chassis reference point may be located on one of an aft portion of the chassis and behind the ground-engaging mechanism.

The compaction value may represent an elevational difference of the as-built surface compacted by the ground engaging-mechanism.

The processor may further control a display device to display one of the compaction value and an elevational difference in real-time as a singular graphic with a compacted surface overlayed with the as-built surface.

The processor may further communicate the compaction value to a follower work machine wherein the follower work machine modifies a ground-engaging attachment coupled to the follower work machine in response to receiving the compaction value.

Modifying movement of the attachment may comprise of adjusting the pitch of the attachment to reflect a desired grade.

The processor may further generate a ground compaction stress map indicative of the compaction values across a worksite, store the ground compaction stress map in a memory, and identify a compaction impact on a subsequent of grading from one or more work machines.

The processor may further access the ground compaction stress map, modify movement of one of the attachment and an alternative attachment, based on the compaction impact from the ground compaction stress map.

The method of sensing ground compaction from a work machine comprises of the following. In a first step, the method includes generating a chassis angle signal from a first sensor coupled to the chassis of the work machine wherein the chassis angle signal is indicative of the chassis angle relative to a direction of gravity. The method also includes generating an attachment spacing signal from a third sensor coupled to the work machine wherein the distance between the attachment and the chassis may be derived. Then, the method includes generating a location signal from a fourth sensor coupled to the work machine wherein the location signal is indicative of either the chassis or the attachment.

In a next step, the method includes receiving the chassis angle signal from the first sensor by a controller of the work machine, receiving the attachment angle signal from the second sensor by the controller, receiving the attachment spacing signal from the third sensor by the controller, and receiving the location signal from the fourth sensor by the controller. Subsequently, the method includes determining an as-built grade of a surface based on an attachment reference at a first location of the location signal, and then determining a compaction value of the as-built surface. The compaction value is based on the chassis angle signal, the attachment angle signal, the attachment spacing signal, and the location signal when a chassis reference point reaches the first location as the work machine traverses across the surface. Finally, the method includes modifying movement of the work machine based on the compaction value.

The method may further comprise communicating the compaction value to a follower work machine wherein the follower work machine modifies a ground-engaging attachment coupled to the follower work machine in response to receiving the compaction value.

The method may further comprise generating a ground compaction stress map indicative of the compaction value across a worksite, store the ground the compaction stress map in a memory, and identify a compaction impact on a subsequent pass of grading from one or more work machines.

The method may further comprise accessing the ground compaction stress map, modifying movement of one of the attachment and an alternative attachment wherein the alternative attachment is coupled to an alternative work machine. The modification occurs based on the compaction impact of a location from the ground compaction map.

The above features and advantages and other features and advantages of the present teachings are readily apparent from the following detailed description of the best modes for carrying out the teachings when taken in connection with the accompanying drawings.

DETAILED DESCRIPTION

Figure 1:
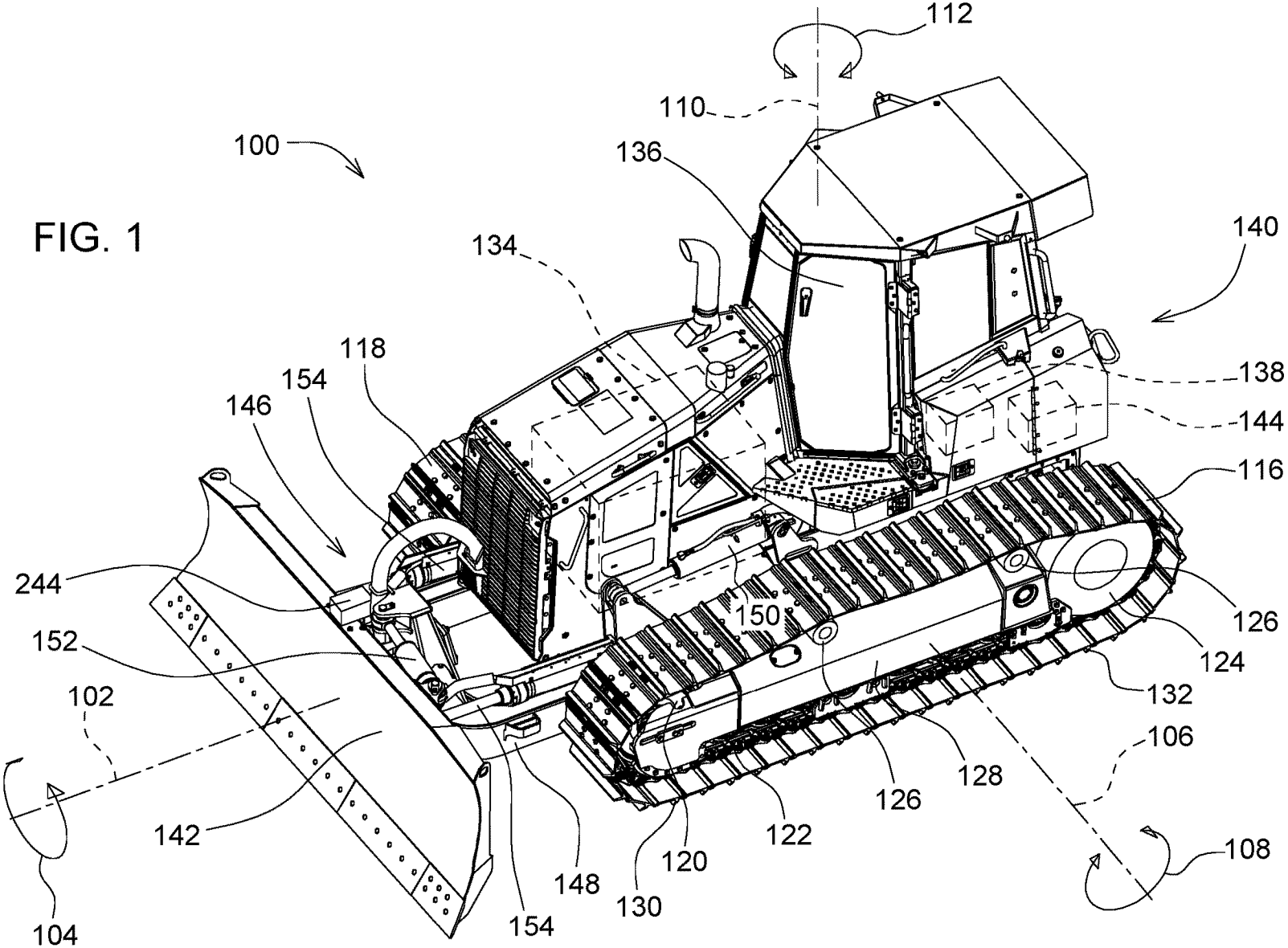
FIG. 1 is a perspective view of one embodiment of a work machine, shown as a crawler dozer.

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Terms of degree, such as "generally", "substantially" or "approximately" are understood by those of ordinary skill to refer to reasonable ranges outside of a given value or orientation, for example, general tolerances or positional relationships associated with manufacturing, assembly, and use of the described embodiments.

In addition, as used herein, the term "or" is an inclusive "or" operator and is equivalent to the term "and/or," unless the context clearly dictates otherwise. The term "based on" is not exclusive and allows for being based on additional factors not described, unless the context clearly dictates otherwise.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C. or any combination of two or more of A, B, and C (e.g., A and B; B and C; A and C; or A, B, and C).

As used herein. "controller" 10 is intended to be used consistent with how the term is used by a person of skill in the art, and refers to a computing component with processing, memory 20, and communication capabilities, which is utilized to execute instructions (i.e., stored on the memory 20 or received via the communication capabilities) to control or communicate with one or more other components. In certain embodiments, the controller 10 may be configured to receive input signals in various formats (e.g., hydraulic signals, voltage signals, current signals, CAN messages, optical signals, radio signals), and to output command or communication signals in various formats (e.g., hydraulic signals, voltage signals, current signals, CAN messages, optical signals, radio signals).

The controller 10 may be in communication with other components on the work machine 100, such as hydraulic components, electrical components, and operator inputs within an operator station of an associated work machine. The controller 10 may be electrically connected to these other components by a wiring harness such that messages, commands, and electrical power may be transmitted between the controller 10 and the other components. Although the controller 10 is referenced in the singular, in alternative embodiments the configuration and functionality described herein can be split across multiple devices using techniques known to a person of ordinary skill in the art. The controller 10 includes the tangible, non-transitory memory 20 on which are recorded computer-executable instructions, including a ground compaction sensing program instructions 40. The processor 30 of the controller 10 is configured for executing the ground compaction sensing program instructions 40.

The controller 10 may be embodied as one or multiple digital computers or host machines each having one or more processors, read only memory (ROM), random access memory (RAM), electrically-programmable read only memory (EPROM), optical drives, magnetic drives, etc., a high-speed clock, analog-to-digital (A/D) circuitry, digital-to-analog (D/A) circuitry, and any required input/output (I/O) circuitry, I/O devices, and communication interfaces, as well as signal conditioning and buffer electronics.

The computer-readable memory may include any non-transitory/tangible medium which participates in providing data or computer-readable instructions. The memory 20 may be non-volatile or volatile. Non-volatile media may include, for example, optical or magnetic disks and other persistent memory. Example volatile media may include dynamic random-access memory (DRAM), which may constitute a main memory. Other examples of embodiments for memory 20 include a floppy, flexible disk, or hard disk, magnetic tape or other magnetic medium, a CD-ROM, DVD, and/or any other optical medium, as well as other possible memory devices such as flash memory.

As such, a method 800 may be embodied as a program or algorithm operable on a controller 10. It should be appreciated that the controller 10 may include any device capable of analyzing data from various sensors, comparing data, making decisions, and executing the required tasks.

FIG. 1 is a perspective view of work vehicle 100. Work machine 100 is illustrated as a crawler dozer, which may also be referred to as a crawler, but may be any work machine with a ground-engaging blade or work implement such as a compact track loader, motor grader, scraper, skid steer, and tractor, to name a few examples. Work machine 100 may be operated to engage the ground and cut and move material to achieve simple or complex features on the ground. As used herein, directions with regard to work machine 100 may be referred to from the perspective of an operator seated within operator station 136: the left of work machine 100 is to the left of such an operator, the right of work machine 100 is to the right of such an operator, the front or fore of work machine 100 is the direction such an operator faces, the rear or aft of work machine 100 is behind such an operator, the top of work machine 100 is above such an operator, and the bottom of work machine 100 is below such an operator. While operating, work machine 100 may experience movement in three directions and rotation in three directions. Direction for work machine 100 may also be referred to with regard to longitude 102 or the longitudinal direction, latitude 106 or the lateral direction, and vertical 110 or the vertical direction. Rotation for work machine 100 may be referred to as roll 104 or the roll direction, pitch 108 or the pitch direction, and yaw 112 or the yaw direction or heading.

Work machine 100 is supported on the ground by chassis 114. Chassis 114 includes left track 116 and right track 118, which engage the ground and provide tractive force for work machine 100. Left track 116 and right track 118 may be comprised of shoes with grousers that sink into the ground to increase traction, and interconnecting components that allow the tracks to rotate about front idlers 120, track rollers 122, rear sprockets 124 and top idlers 126. Such interconnecting components may include links, pins, bushings, and guides, to name a few components. Front idlers 120, track rollers 122, and rear sprockets 124, on both the left and right sides of work machine 100, provide support for work machine 100 on the ground. Front idlers 120, track rollers 122, rear sprockets 124, and top idlers 126 are all pivotally connected to the remainder of work machine 100 and rotationally coupled to their respective tracks so as to rotate with those tracks. Track portion 128 of the chassis 114 provides structural support or strength to these components and the remainder of chassis 114.

Front idlers 120 are positioned at the longitudinal front of left track 116 and right track 118 and provide a rotating surface for the tracks to rotate about and a support point to transfer force between work machine 100 and the ground. Left track 116 and right track 118 rotate about front idlers 120 as they transition between their vertically lower and vertically upper portions parallel to the ground, so approximately half of the outer diameter of each of front idlers 120 is engaged with left track 116 or right track 118. This engagement may be through a sprocket and pin arrangement, where pins included in left track 116 and right track 118 are engaged by recesses in front idler 120 so as to transfer force. This engagement also results in the vertical height of left track 116 and right track 118 being only slightly larger than the outer diameter of each of front idlers 120 at the longitudinal front of left track 116 and right track 118. Frontmost engaging point 130 of left track 116 and right track 118 can be approximated as the point on each track vertically below the center of front idlers 120, which is the frontmost point of left track 116 and right track 118 which engages the ground. When work machine 100 encounters a ground feature when traveling in a forward direction, left track 116 and right track 118 may first encounter it at frontmost engaging point 130. If the ground feature is at a higher elevation than the surrounding ground surface (i.e., an upward ground feature), work machine 100 may begin pitching backward (which may also be referred to as pitching upward) when frontmost engaging point 130 reaches the ground feature. If the ground feature is at a lower elevation than the surrounding ground surface (i.e., a downward ground feature), work machine 100 may continue forward without pitching until the center of gravity of work machine 100 is vertically above the edge of the downward ground feature. At that point, work machine 100 may pitch forward (which may also be referred to as pitching downward) until frontmost engaging point 130 contacts the ground. In this embodiment, front idlers 120 are not powered and thus are freely driven by left track 116 and right track 118. In alternative embodiments, front idlers 120 may be powered, such as by an electric or hydraulic motor, or may have an included braking mechanism configured to resist rotation and thereby slow the left track 116 and right track 118.

Track rollers 122 are longitudinally positioned between front idler 120 and rear sprocket 124 along the bottom left and bottom right sides of work machine 100. Each of track rollers 122 may be rotationally coupled to left track 116 or right track 118 through engagement between an upper surface of the tracks and a lower surface of track rollers 122. This configuration may allow track rollers 122 to provide support to work machine 100, and in particular may allow for the transfer of forces in the vertical direction between work machine 100 and the ground. This configuration also resists the upward deflection of left track 116 and right track 118 as they traverse an upward ground feature whose longitudinal length is less than the distance between front idler 120 and rear sprocket 124.

Rear sprockets 124 may be positioned at the longitudinal rear of left track 116 and right track 118 and, similar to front idlers 120, provide a rotating surface for the tracks to rotate about and a support point to transfer force between work machine 100 and the ground. Left track 116 and right track 118 rotate about rear sprockets 124 as they transition between their vertically lower and vertically upper portions parallel to the ground, so approximately half of the outer diameter of each of rear sprockets 124 is engaged with left track 116 or right track 118. This engagement may be through a sprocket and pin arrangement, where pins included in left track 116 and right track 118 are engaged by recesses in rear sprockets 124 so as to transfer force. This engagement also results in the vertical height of left track 116 and right track 118 being only slightly larger than the outer diameter of each of rear sprockets 124 at the longitudinal back or rear of left track 116 and right track 118. Rearmost engaging point 132 of left track 116 and right track 118 can be approximated as the point on each track vertically below the center of rear sprockets 124, which is the rearmost point of left track 116 and right track 118 which engages the ground.

In this embodiment, each of rear sprockets 124 may be powered by a rotationally coupled hydraulic motor so as to drive the left track 116 and right track 118 and thereby control propulsion and traction for work machine 100. Each of the left and right hydraulic motors may receive pressurized hydraulic fluid from a hydrostatic pump 138 whose direction of flow and displacement controls the direction of rotation and speed of rotation for the left and right hydraulic motors. Each hydrostatic pump 138 may be driven by engine 134 of work machine 100 and may be controlled by an operator in operator station 136 issuing commands which may be received by controller 10 and communicated to the left and right hydrostatic pumps 138 by controller 10. In alternative embodiments, each of rear sprockets 124 may be driven by a rotationally coupled electric motor or a mechanical system transmitting power from engine 134.

Top idlers 126 are longitudinally positioned between front idlers 120 and rear sprockets 124 along the left and right sides of work vehicle 100 above track rollers 122. Similar to track rollers 122, each of top idlers 126 may be rotationally coupled to left track 116 or right track 118 through engagement between a lower surface of the tracks and an upper surface of top idlers 126. This configuration may allow top idlers 126 to support left track 116 and right track 118 for the longitudinal span between front idler 120 and rear sprocket 124 and prevent downward deflection of the upper portion of left track 116 and right track 118 parallel to the ground between front idler 120 and rear sprocket 124.

A first sensor 144 is affixed to chassis 140 of work vehicle 100 and configured to provide a chassis angle signal 202 indicative of the movement and orientation of chassis 140. In alternative embodiments, first sensor 144 may not be affixed directly to chassis 140 but may instead be connected to chassis 140 through intermediate components or structures, such as rubberized mounts. Connecting the first sensor 144 to chassis 140 in a fixed relative position through the use of mounts or brackets may allow first sensor 144 to experience and measure the motion of chassis 140, enabling measurements by first sensor 144 to be indicative of the similar measurements taken from the first sensor directly affixed to chassis 140.

The first sensor 144 is a component configured to provide a signal indicative of the angle of chassis 140 in the direction of roll 104 and the angular velocity of chassis 140 in the direction of roll 104. For example, these signals may be referred to as a chassis tilt signal and a chassis roll signal, respectively. First sensor 144 may also be configured to provide a signal or signals indicative of other positions or velocities of chassis 140, including its inclination (i.e., an angle of chassis 140 relative to the direction of gravity) in a direction such as the direction of roll 104, pitch 108, and yaw 112, its angular velocity or angular acceleration in a direction such as the direction of roll 104, pitch 108, yaw 112, or its linear velocity or linear acceleration in a direction such as the direction of longitude 102, latitude 106, and vertical 110. These may collectively be referred to chassis angle signal 202. First sensor 144 may be configured to directly measure angular acceleration, angular velocity, or angular position, or measure one of these and derive or integrate the measurements to arrive at another of these (e.g., integrate angular velocity to arrive at angular position).

Attachment 142 may be a blade or other type of tool which may engage the ground or material to move or shape it. Attachment 142 may be used to move material from one location to another to create features on the ground, including flat areas, grades, hills, roads, or more complexly shaped features. In this embodiment, attachment 142 of work vehicle 100 may hereinafter be referred to as a blade, a six-way blade, six-way adjustable blade, or power-angle-tilt (PAT) blade. Attachment 142 may be hydraulically actuated to move vertically up or vertically down (which may also be referred to as lift, or raise and lower), roll left or roll right (which may be referred to as tilt, or tilt left and tilt right), and yaw left or yaw right (which may be referred to as blade angle, or angle left and angle right). Alternative embodiments may utilize an attachment with fewer hydraulically controlled degrees of freedom, such as a 4-way attachment that may not be angled or actuated in the direction of yaw 112.

Attachment 142 is movably coupled to the chassis 140 of work machine 100 through linkage 146, which supports and actuates attachment 142 and is configured to allow attachment 142 to be tilted relative to chassis 140 (i.e., moved in the direction of roll 104). Linkage 146 may include multiple structural members to carry forces between blade 142 and the remainder of work vehicle 100 and may provide attachment points for hydraulic cylinders which may actuate the attachment in the lift, tilt, and angle directions.

In the present embodiment, linkage 146 includes a c-chassis 148, a structural member with a C-shape positioned rearward of blade 142, with the C-shape open toward the rear of work vehicle 100. Each rearward end of c-chassis 148 is pivotally connected to chassis 140 of work vehicle 100, such as through a pin-bushing joint, allowing the front of c-chassis 148 to be raised or lowered relative to work vehicle 100 about the pivotal connections at the rear of c-chassis 148. The front portion of c-chassis 148, which is approximately positioned at the lateral center of work vehicle 100, connects to blade 142 through a ball-socket joint. This allows blade 142 three degrees of freedom in its orientation relative to c-chassis 148 (lift-tilt-angle) while still transferring rearward forces on blade 142 to the remainder of work vehicle 100.

Figure 2:
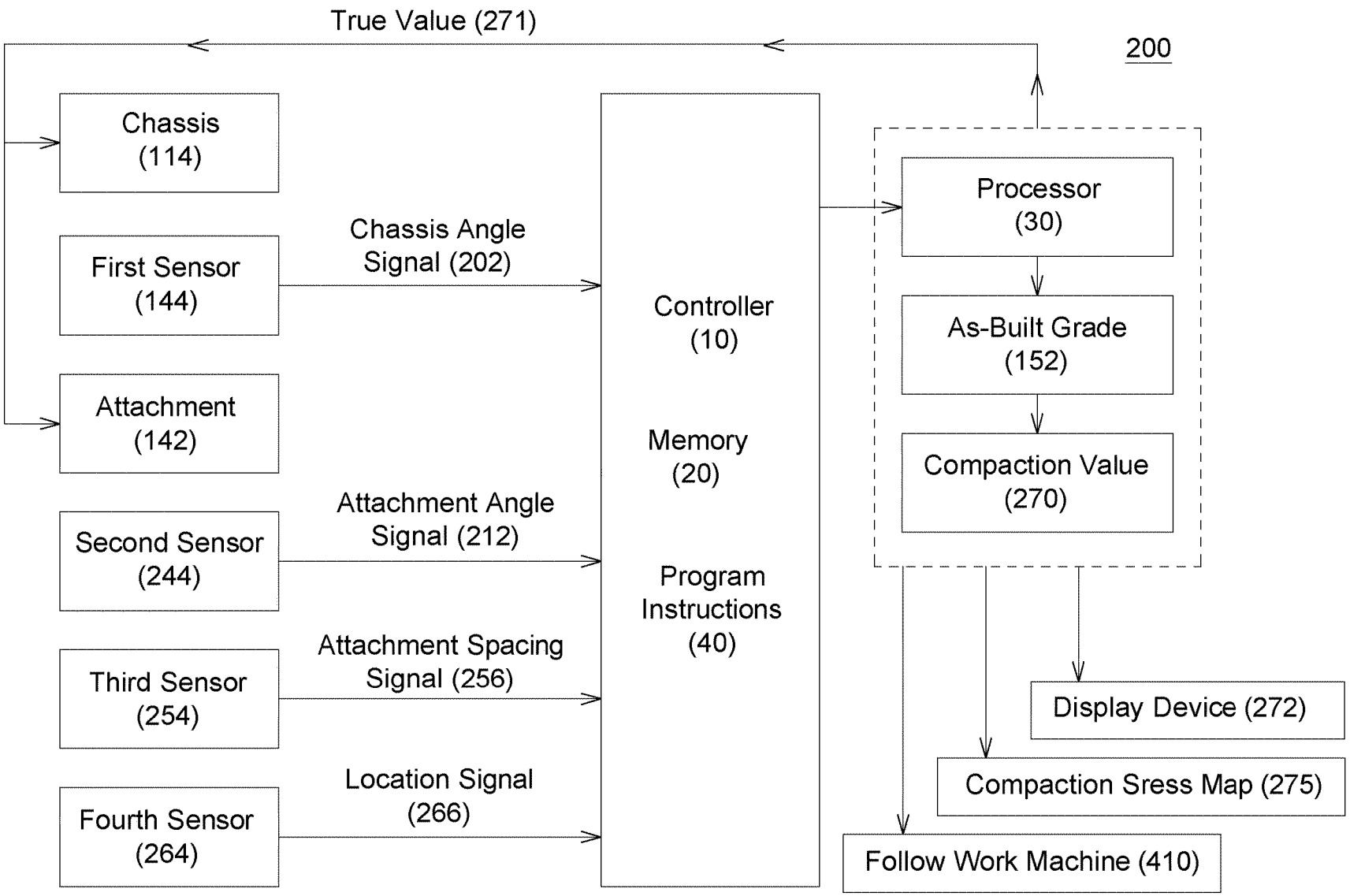
FIG. 2 is a block diagram of one embodiment of the system architecture and the flow of the ground compaction sensing system.
Figure 3:
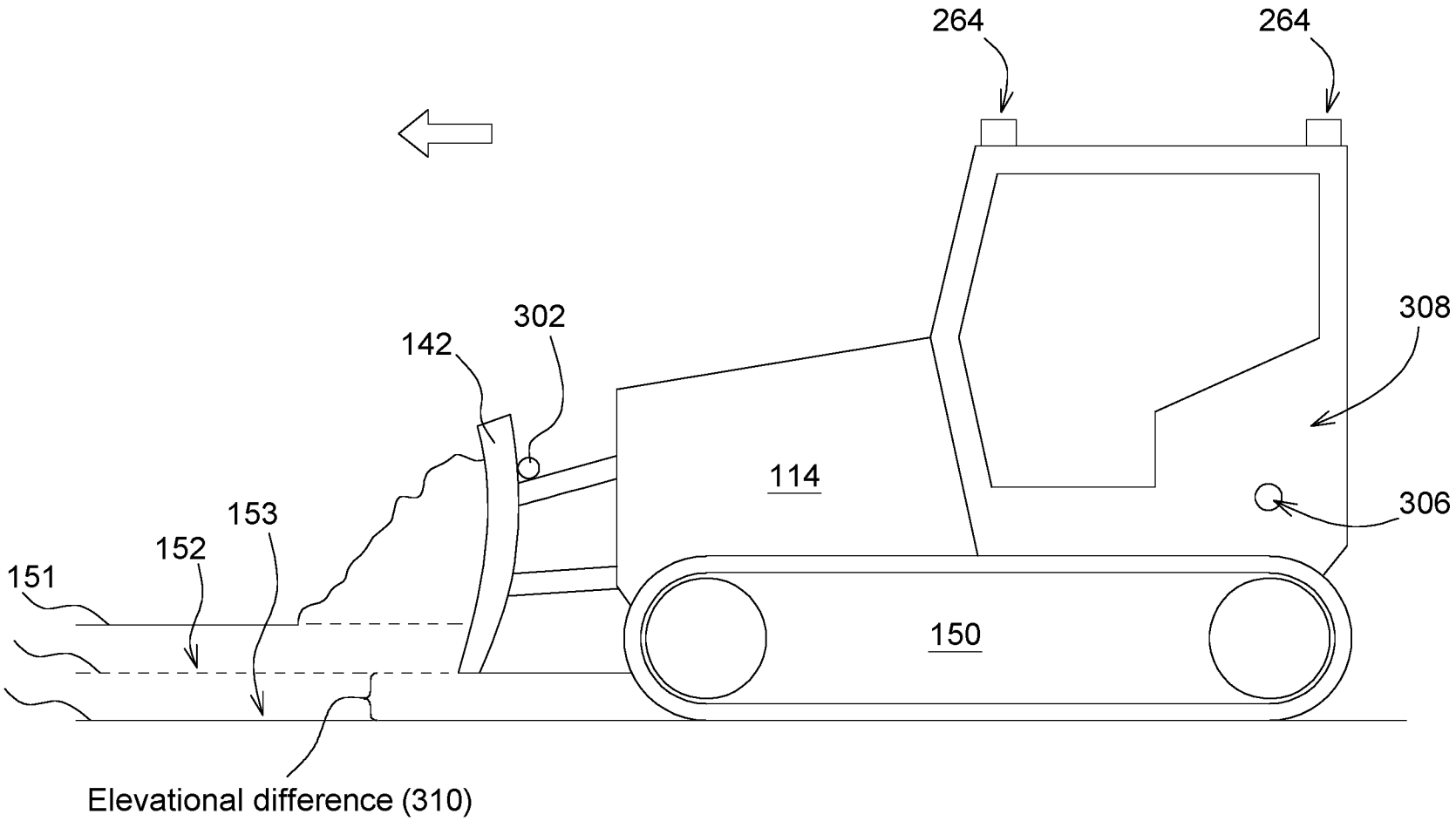
FIG. 3 is an illustration depicting a work surface during a grading operation with the work machine.
Figure 4:
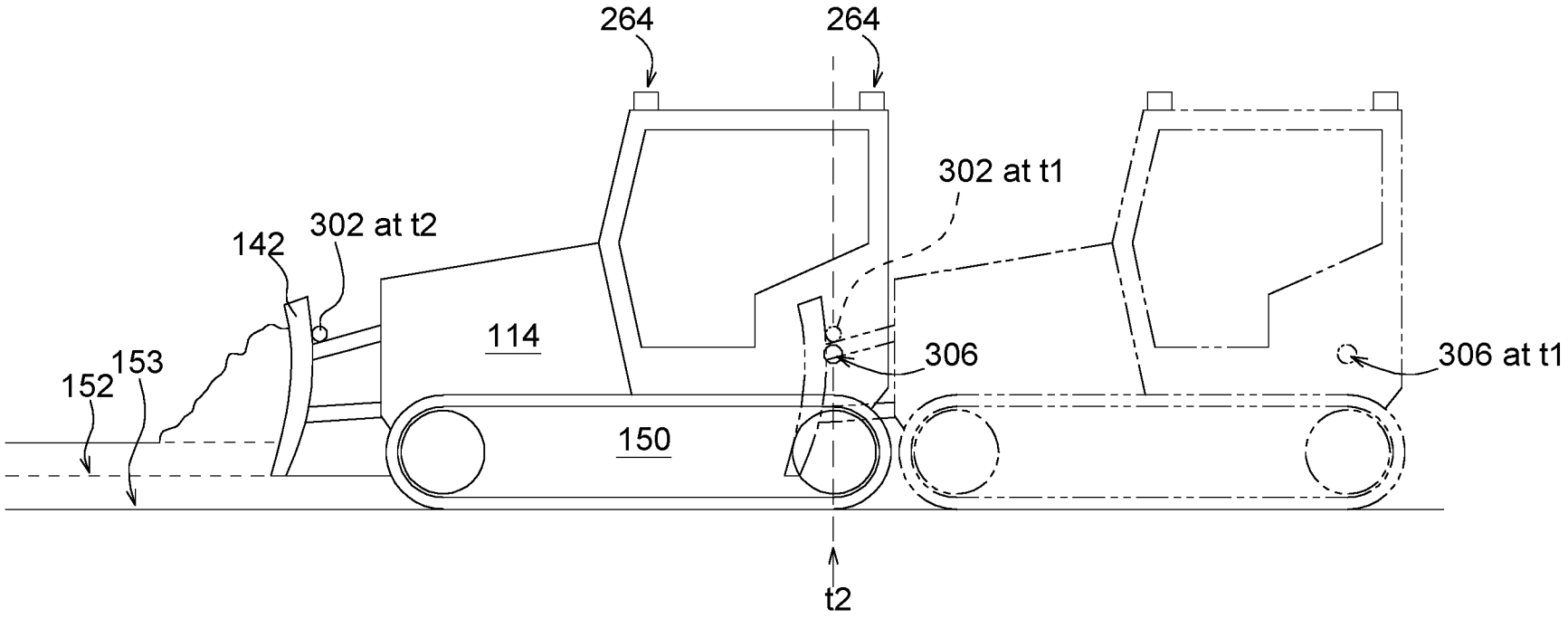
FIG. 4 is an illustration depicting a work surface during a grading operation with a follower work machine.

Now referring to FIGS. 2-4, a ground compaction sensing system 200 for a work machine 100 assists in grading operations using an attachment 142. The ground compaction sensing system 200 may comprise of the chassis 140, the ground-engaging mechanism 150 coupled to the chassis 140, and a multitude of sensors coupled to the controller 10. The first sensor 144 is coupled to the chassis 140 and configured to generate a chassis angle signal 202 indicative of a chassis angle 204 relative to a direction of gravity.

A second sensor 244, functionally similar to the first sensor 144, is coupled to the attachment 142 wherein the second sensor 244 is configured to generate an attachment angle signal 212 indicative of an attachment angle 214 relative to the direction of gravity. The second sensor 244 is configured to directly measure angular acceleration, angular velocity, or angular position, or measure one of these and derive or integrate the measurements to arrive at another of these (e.g., integrate angular velocity to arrive at angular position). The second sensor 244 may be affixed to blade 142 above the ball-socket joint connecting blade 142 to c-chassis 148. The second sensor 244, like the first sensor 144, may be configured to measure orientation, angular velocity, or acceleration. Second sensor 244 may be connected to blade 142 through an intermediate component, such as a bracket, mount, or portion of linkage 146, at a fixed relative position to blade 142 so that may experience and measure the motion of blade 142, enabling measurements by second sensor 244 to be indicative of similar measurements taken from a sensor directly affixed to blade 142. Second sensor 244 may include one more gyroscopes which it may use to sense angular velocities and one or more accelerometers which it may use to measure linear acceleration. Second sensor 244 may sense the tilt angle of blade 142 by measuring linear acceleration in three substantially perpendicular axes, and using those measurements to determine the direction of gravity and thereby determine the tilt angle of blade 142.

Blade 142 may be raised or lowered relative to work vehicle 100 by the actuation of lift cylinders, which may raise and lower c-chassis 148 and thus raise and lower blade 142, which may also be referred to as blade lift. For each of lift cylinders, the rod end is pivotally connected to an upward projecting clevis of c-chassis 148 and the head end is pivotally connected to the remainder of work vehicle 100 just below and forward of operator station 136. The configuration of linkage 146 and the positioning of the pivotal connections for the head end and rod end of lift cylinders results in the extension of lift cylinders lowering blade 142 and the retraction of lift cylinders raising blade 142. In alternative embodiments, blade 142 may be raised or lowered by a different mechanism, or lift cylinders may be configured differently, such as a configuration in which the extension of lift cylinders raises blade 142 and the retraction of lift cylinders lowers blade 142.

Blade 142 may be tilted relative to work vehicle 100 by the actuation of tilt cylinder, which may also be referred to as moving blade 142 in the direction of roll 104. For tilt cylinder, the rod end is pivotally connected to a clevis positioned on the back and left sides of blade 142 above the ball-socket joint between blade 142 and c-chassis 148 and the head end is pivotally connected to an upward projecting portion of linkage 146. The positioning of the pivotal connections for the head end and the rod end of tilt cylinder result in the extension of tilt cylinder tilting blade 142 to the left or counterclockwise when viewed from operator station 136 and the retraction of tilt cylinder tilting blade 142 to the right or clockwise when viewed from operator station 136. In alternative embodiments, blade 142 may be tilted by a different mechanism (e.g., an electrical or hydraulic motor) or tilt cylinder may be configured differently, such as a configuration in which it is mounted vertically and positioned on the left or right side of blade 142, or a configuration with two tilt cylinders.

Blade 142 may be angled relative to work vehicle 100 by the actuation of angle cylinders 154, which may also be referred to as moving blade 142 in the direction of yaw 112. For each of angle cylinders 154, the rod end is pivotally connected to a clevis of blade 142 while the head end is pivotally connected to a clevis of c-chassis 148. One of the angle cylinders 154 is positioned on the left side of work vehicle 100, left of the ball-socket joint between blade 142 and c-chassis 148, and the other of the angle cylinders 154 is positioned on the right side of work vehicle 100, right of the ball-socket joint between blade 142 and c-chassis 148. This positioning results in the extension of the left of angle cylinders 154 and the retraction of the right of angle cylinders 154 angling blade 142 rightward, or yawing blade 142 clockwise when viewed from above, and the retraction of left of angle cylinder 154 and the extension of the right of angle cylinders 154 angling blade 142 leftward, or yawing blade 142 counterclockwise when viewed from above. In alternative embodiments, blade 142 may be angled by a different mechanism or angle cylinders 154 may be configured differently.

A third sensor 254 is configured to generate an attachment spacing signal 256 wherein a distance between the attachment 142 and the chassis 140 may be derived. More specifically, the third sensor 254 senses, in the fore-aft direction, one of the spacing between a first point on the chassis 140 relative to a second point on the attachment and a change in spacing therebetween, as the attachment is moved. The third sensor 254 is configured to directly measure the spacing, or can be defined as a derived spacing or change in spacing through pre-existing sensors such as hydraulic sensors related to linkage kinematics.

A fourth sensor 264 is configured to generate a location signal 266 indicative of a location of one of the chassis 140 and the attachment 142. In one embodiment, the fourth sensor 264 derive a location of the work machine from one or more of a base station and a global navigation satellite system (GNSS) receiver. The GNSS receiver can receive and compute its position from the signals provided by the global navigation satellites. The work machine 100, in addition to knowing its own position (as computed from the detected satellite signals received), may also be provided with a location signal 266 from a base station at a known and fixed position. The controller 10 has a non-transitory computer readable medium with a program instruction 40 to grade the surface 50. The program instructions 40 when executed cause a processor 30 of the controller 10 to perform the following. The processor 30 receives the chassis angle signal 202 from the first sensor 144; the attachment angle signal 212 from the second sensor 244; the attachment spacing signal 256 from the third sensor 254; and a location signal 265 from the fourth sensor 264.

A chassis reference point 306 is located on an aft portion 308 of the chassis 140 and proximal to the ground-engaging mechanism 150. In the embodiment shown in FIG. 3, the attachment reference point 302 may be located on or around the ball joint (for this particular embodiment) behind the attachment 142. In other embodiments, the attachment reference point 302 may be on or proximal to the attachment 142 such as an attachment coupler, or a linkage.

Figure 5:
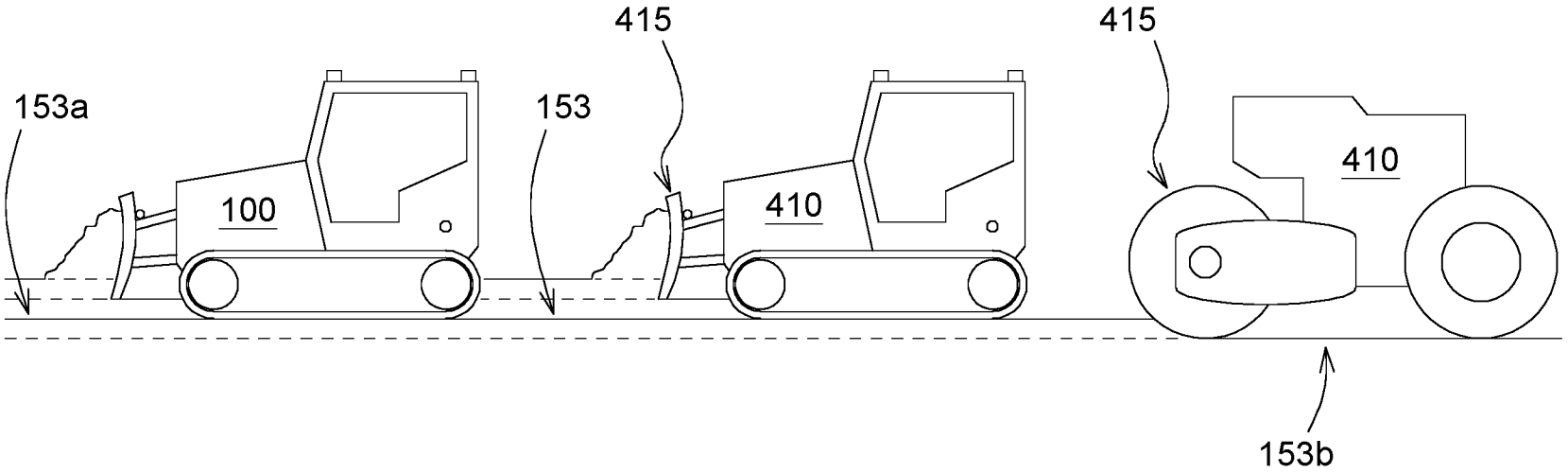
FIG. 5 is an illustration of a worksite using the ground compaction sensing system.

The program instructions 40 for the processor 30 will determine an as-built surface 152 (may also be referred to as an as-built grade) of the virgin surface 151 based on the attachment reference point 302 at a first location 304 of the location signal 266. As used herein, "based on" means "based at least in part on" and does not mean "based solely on," such that it neither excludes nor requires additional factors. As shown in FIG. 4, the work machine 100 is moving in the direction of the arrow. A compaction value 270 represents an elevational difference 310 of the as-built surface 152 and the as-built surface compacted 153 by the ground-engaging mechanism 150. The schematic of the work machine in dotted lines is the work machine at $t_1$. The schematic of the work machine in solid lines is the work machine at $t_2$. FIG. 5 identifies a first as-built compacted 153*a* by loader further compacted by a follower work machine 410 with a roller attachment 415 to create a second as-built compacted surface 153*b*.

The compaction value 270 of the as-built surface 152 is based on or derived from the chassis angle signal 202, the attachment angle signal 212, and the attachment spacing signal 256 when the chassis reference point 306 at $t_1$ reaches the first location 304 (i.e. where the attachment reference point 302 was at $t_1$) at a later time $t_2$ as the work machine 100 traverses across the surface 50. The compaction value 270 is tracked in real-time as it can be calculated in seconds. In response, the program instructions 40 may cause a processor 30 on the controller 10 to modify movement of the attachment 142 based upon the compaction value 270. Note the attachment reference point 302 and the chassis reference point 306 need not be in the same plane to calculate the compaction value 270.

Figure 6A:
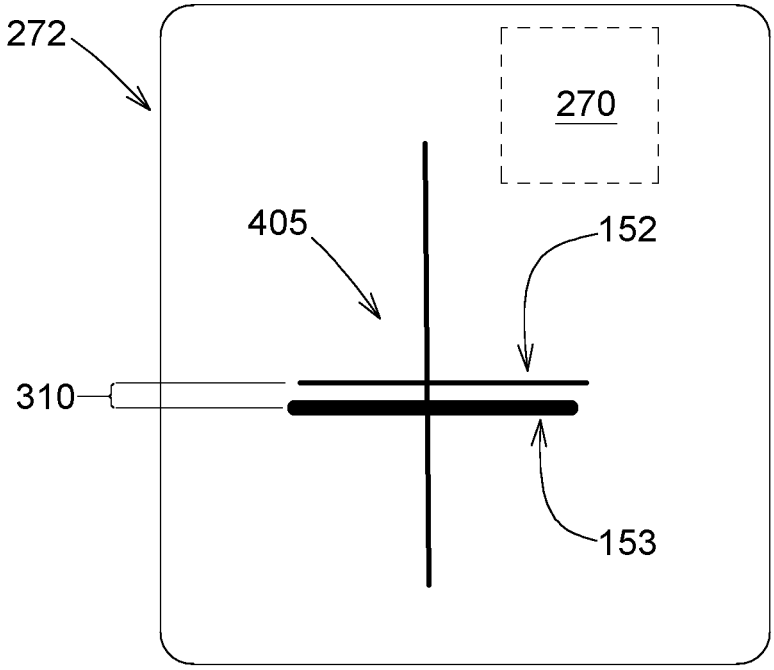
FIG. 6*a* is an exemplary embodiment of a display device showing a compaction value in real-time.

Now turning to FIG. 6A, the program instructions 40 when executed further causes the processor 30 of the controller 10 to control a display device 272 to display a real-time elevational difference 310 as a singular graphic 405 with a compacted surface 153 (shown in a bold line) overlayed with the as-built surface 152. The grade profile of the as built surface 152 attachment 142 (e.g. cross slope and mainfall), in one embodiment, may be derived from receiving localized attachment corner positions wherein the attachment 142 is a blade. The program instructions 40 when executed further causes the processor 30 of the controller 10 to control a display device 272 to display the compaction value 270. The compaction value 270 may be represented as a nominal value, a percentage of the desired grade, an in/out of tolerance indicator, or a number of passes remaining based on the true value 271 (i.e. the surface grade post compaction).

The program instructions 40 when executed may further cause the processor 30 of the controller 10 to communicate the compaction value 270 to a follower work machine 410

Figure 6B:
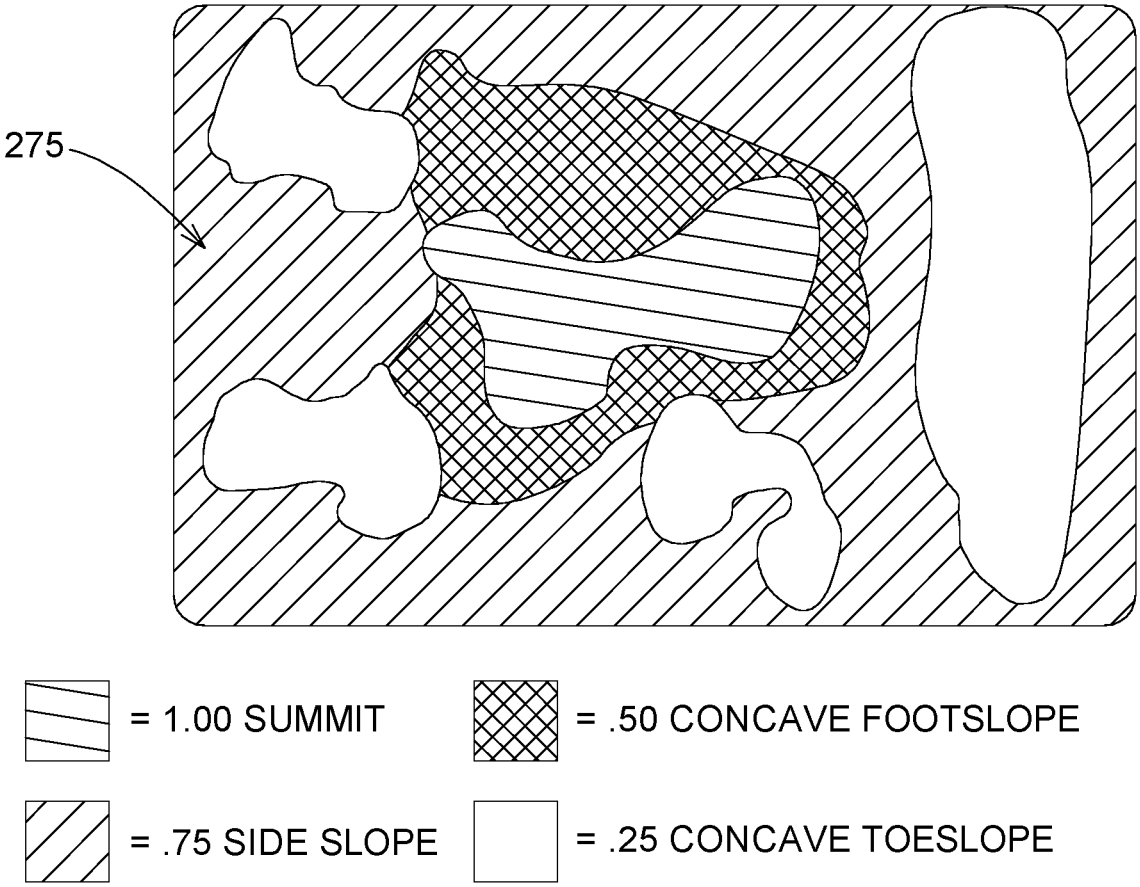
FIG. 6*b* is an exemplary embodiment of a display device showing a ground compaction stress map.

(hereinafter also referred to as "alternative work machine") wherein the follower work machine 410 adjusts the ground-engaging attachment 142 coupled to the follower work machine 410 in response to receiving the compaction value 270. In industrial applications, compaction of large deposits of soil is required in road building wherein some areas may require artificial fills and others may require embankments. Compaction can be especially important when forming the foundation under bridge piers, buildings, roads, dams, levees, airports, and parks, e.g. Furthermore, the process can require multiple layers of materials such as the sub-grade, a drainable aggregate rock base, and then an asphalt base. An initial pass may be performed by a first work machine 100 with a blade type attachment, and a follower work machine 410 may follow with a drum type attachment for further compaction. The program instructions 40 for acquiring the true value 271 (i.e. the grade post compaction) or compaction value 270 may iteratively repeat with each pass, or with each follower work machine 410, and thereby advantageously avoiding a potential cumulative error in grading operations, improve accuracy, and create a more uniform compaction of the worksite. Referring to FIG. 6B, a well-understood map of compaction over an entire worksite (i.e. ground compaction stress map 275) may advantageously enable restructuring of the time allotted from several difference work machines to specific areas. Use of compaction knowledge from the work machines can improve material handling practices by proactively leaving more material in low compaction areas during subsequent passes. For example, in road building, a worksite with fewer low compaction areas can reduce the aggregate required for filing in the next layer, and thereby aggregate material costs.

Additionally, the program instructions 40 when executed may cause the processor 30 of the controller 10 to generate a ground compaction stress map 275 (shown in FIG. 6B) indicative of the compaction values 270 across a worksite 280; store the ground compaction stress map 275 in a memory 20; and identify a compaction impact 420 on a subsequent pass of grading from one or more work machines. The ground compaction stress map 275 can indicate the degree of elevational differences 310 within a worksite and displayed as color-coded overlay of a worksite map. These values may be initially established during an initial pass of a given work area. In one embodiment, the ground compaction stress map 275 can be calibrated with a few manual soil-compaction tests at specific locations and identify the relationship between machine weight and soil compaction, as soil compaction may be machine specific. Calibrating may also automatically compensate for moisture and soil type, and thereby further improving the accuracy. The ground compaction sensing system integrated with known grade control systems provides a more accurate assessment, and further provides this information in real-time.

The program instructions 40 when executed may further cause the processor 30 of the controller 10 to access the ground compaction stress map 275; modifying movement of one of the attachment 142 in a subsequent pass, or an alternative attachment 410 from one or more alternative work machines 410. Potential improvements to grade control functions can be used the in creates understanding of compaction. For example, an accurate elevation difference between in real-time of the as-built surface 152 and the compacted surface 153 can inform the operator to adjusts the amount of material flowing under the blade attachment 142 by altering the attachment position and angle. The improved accuracy can further enable the work machine to adjust the attachment to perform a compaction and finishing elevation simultaneously.

Figure 7:
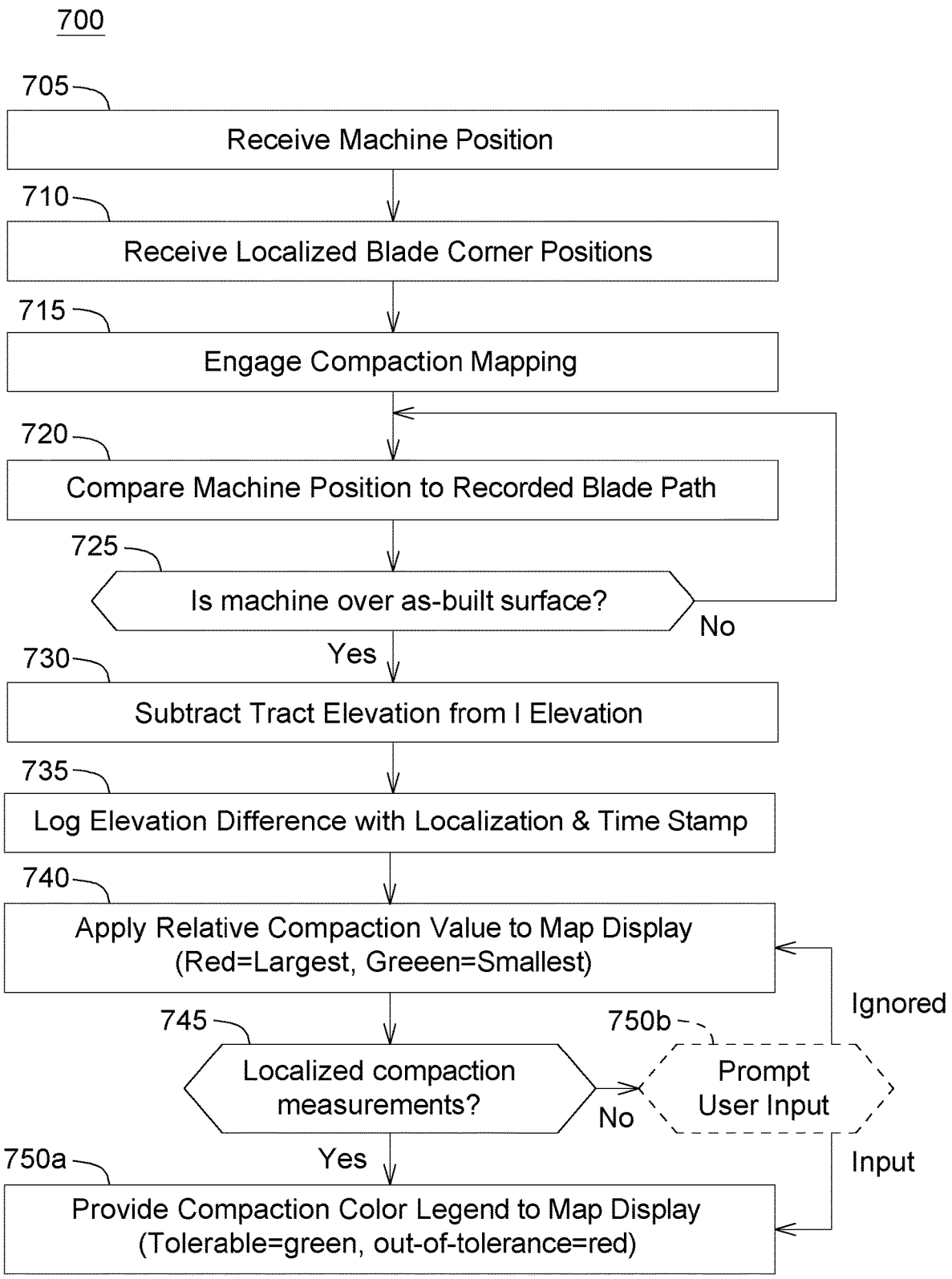
FIG. 7 is a method of sensing ground compaction with a work machine using grade control according to a first embodiment.

FIG. 7 is one embodiment of a logic flow diagram 700 of the program instructions 40 for the ground compaction sensing system 200. The system 200 includes a series of processing instructions or steps from the controller 10 that are depicted in flow diagram form. The process begins with the controller 10 receiving the work machine position in step 705. This includes receiving both the chassis angle signal 202 and the location signal. In step 710, the controller 10 receives the attachment angle signal through identifying the localized blade corner positions when the attachment is blade. Positioning of the attachment relative to the chassis 140 may also be derived from the attachment angle signal. In step 715, the controller 10 engages a compaction map. Subsequently in step 720, the controller 10 compares the work machine position to a previously recorded blade path. The controller 10 then determines if the work machine is over an as-built surface in step 725. If yes, then the controller 10 will subtract the compacted surface value with the as-built surface value to acquire the elevational difference in step 730. If not, the controller 10 will continue checking its location with the previously recorded blade path. In step 735, the controller 10 will log the elevation difference with a location and time stamp. In step 740, the controller 10 will apply the compaction values 270 in relation to a map of the worksite wherein "red" may indicate greater compaction, and green may indicate "less" compaction. Based on the location compaction value measurements in step 745, the controller 10 can alter the map to display whether the true grade is within or out of tolerance in step 750*a*. If localized compaction values 270 are not acquired, the controller 10 may prompt the user 750*b* to activate applying the relative compaction values to the map.

Figure 8:
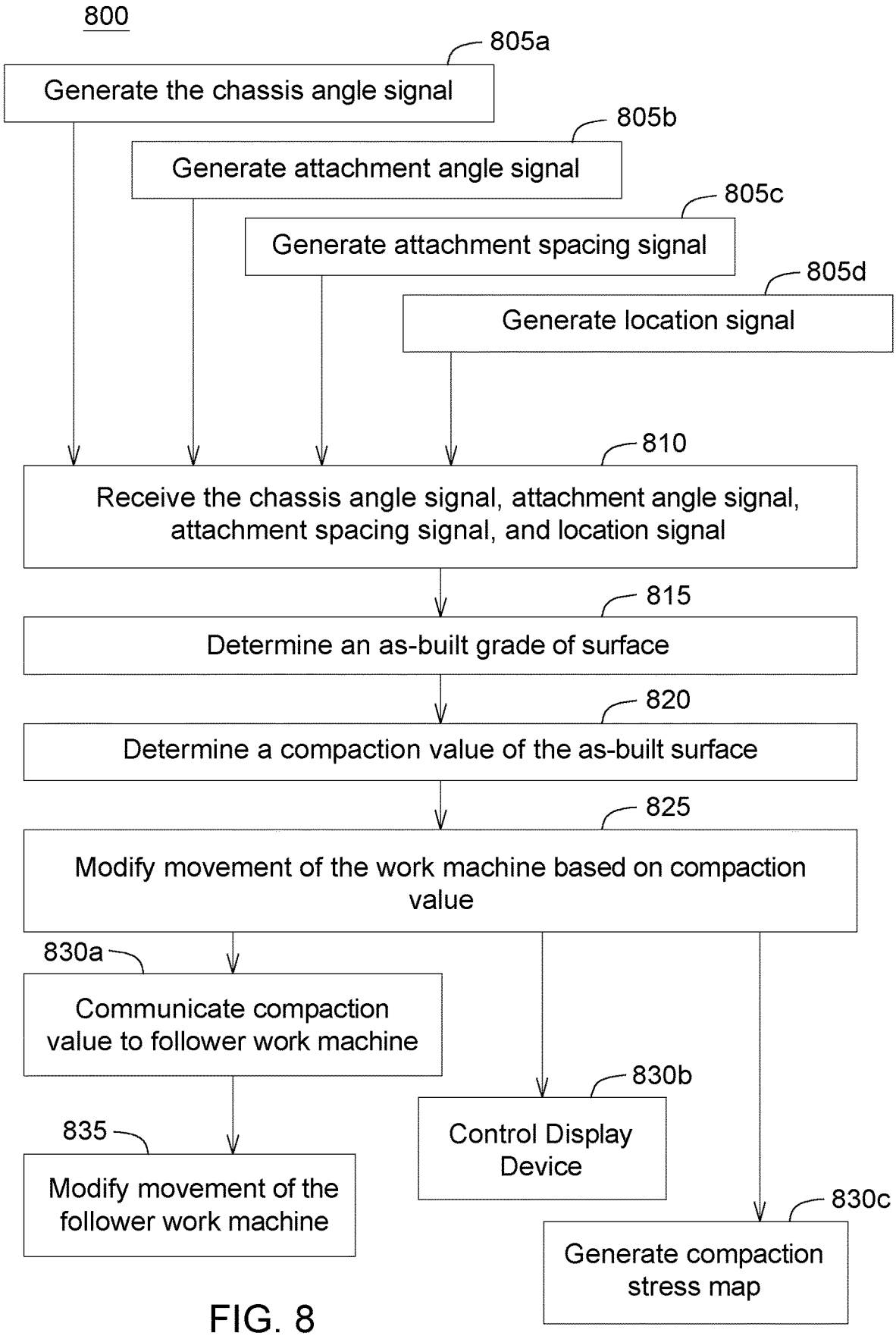
FIG. 8 is a logic flow diagram of the ground compaction sensing program instructions.

FIG. 8 discloses a method 800 of sensing ground compaction with a work machine 100 using grade control according to one embodiment. The method comprises, in step 805*a*, generating a chassis angle signal from a first sensor coupled to the chassis 140 of the work machine 100. The chassis angle signal is indicative of a chassis angle relative to the direction of gravity. In step 805*b*, the method includes generating an attachment angle signal from a second sensor coupled to an attachment of the work machine 100. The attachment angle signal is indicative of the attachment angle relative to the direction of gravity. In step 805*c*, the method includes generating an attachment spacing signal from a third sensor coupled to the work machine 100, wherein a distance between the attachment and the chassis 140 may be derived. In step 805*d*, the method includes generating a location signal 266 from a fourth sensor coupled to the work machine 100 wherein the location signal 266 is indicative of one of the chassis 140 and the attachment. In step 810, the method includes receiving the chassis angle signal, the attachment angle signal, the attachment spacing signal, and the location signal 266. Step 815 includes determining an as-built grade of the surface. Step 820 includes determining a compaction value of the as-built surface. Step 825 includes modifying movement of the work machine 100 based on compaction value 270. In step 830*a*, the method includes communicating the location specific compaction values 270 to one or more follower work machines 410 and modifying movement of the follower work machine 410 based on the localized compaction values 270 in step 835. Additionally, the method in step 830*b* can include controlling a display device to display one of the compaction value 270 and a real-time elevational difference as a singular graphic with a compacted surface 153 overlayed with the as-built surface. Alternatively, in step 830*c*, the method includes generating a ground compaction stress map indicative of the compaction values 270 across a worksite, storing the ground compaction stress map in memory 20, and identifying the compaction impact on a subsequent pass of grading from one or more work machines (100, 410).

The ground compaction sensing system and method for a work machine with grade control disclosed herein has certain advantages. Notably, the system can maintain accuracy and continuity of the grading operation, and thereby eliminating inefficiencies in the process. Furthermore, the system enables a work machine 100 to run automated by self-correcting in equipment function, without necessarily requiring an operator to be present in the work machine 100.

As used herein, "e.g." is utilized to non-exhaustively list examples, and carries the same meaning as alternative illustrative phrases such as "including," "including, but not limited to," and "including without limitation." As used herein, unless otherwise limited or modified, lists with elements that are separated by conjunctive terms (e.g., "and") and that are also preceded by the phrase "one or more of," "at least one of," "at least," or a like phrase, indicate configurations or arrangements that potentially include individual elements of the list, or any combination thereof. For example. "at least one of A, B. and C" and "one or more of A, B, and C" each indicate the possibility of only A. only B. only C, or any combination of two or more of A, B, and C (A and B; A and C; B and C; or A, B, and C). As used herein, the singular forms "a". "an" and "the" are intended to include the plural forms as well, unless the context clearly indicates otherwise. Further, "comprises," "includes," and like phrases are intended to specify the presence of stated features, steps, operations, elements, and/or components, but do not preclude the presence or addition of one or more other features, steps, operations, elements, components, and/or groups thereof.

The invention claimed is:

1. A ground compaction sensing system for a work machine, the work machine extending in a fore-aft direction, the ground compaction sensing system comprising:

a chassis;

a ground-engaging mechanism coupled to the chassis;

a grading attachment movably coupled to the chassis;

a first sensor coupled to the chassis, the first sensor configured to generate a chassis angle signal indicative of a chassis angle relative to a direction of gravity;

a second sensor coupled to the grading attachment, the second sensor configured to generate a grading attachment angle signal indicative of an attachment angle relative to the direction of gravity;

a third sensor configured to generate an attachment spacing signal wherein a distance between the attachment and the chassis is derived;

a fourth sensor configured to generate a location signal indicative of a location of one of the chassis and the grading attachment; and a controller having a non-transitory computer readable medium with a program instruction to grade a surface, the program instructions when executed causing a processor of the controller to:

receive the chassis angle signal from the first sensor;

receive the attachment angle signal from the second sensor;

receive the attachment spacing signal from the third sensor;

receive the location signal from the fourth sensor;

determining an as-built grade of the surface based on an attachment reference point at a first location of the location signal;

determining a compaction value of the as-built surface based on the chassis angle signal, the attachment angle signal, and the attachment spacing signal when a chassis reference point reaches the first location as the work machine traverses across the surface, wherein the compaction value is an elevational difference of the as-built surface and the as-built surface compacted by the ground-engaging mechanism; and modifying movement of the grading attachment based on the compaction value.

2. The ground compaction sensing system of claim 1 wherein the chassis reference point is located on one of an aft portion of the chassis and behind the ground-engaging mechanism.

3. The ground compaction sensing system of claim 1 wherein the program instructions when executed further causes the processor of the controller to control a display device to display one of the compaction value and an elevational difference in real-time as a singular graphic with a compacted surface overlayed with the as-built surface.

4. The ground compaction sensing system of claim 1 wherein the program instructions when executed further causes the processor of the controller to communicate the compaction value to a follower work machine wherein the follower work machine modifies a ground-engaging attachment coupled to the follower work machine in response to receiving the compaction value.

5. The ground compaction sensing system of claim 1 wherein the modifying movement of the grading attachment comprises adjusting a pitch of the grading attachment to reflect a desired grade.

6. The ground compaction sensing system of claim 1 wherein the program instructions when executed further causes the processor of the controller to generate a ground compaction stress map indicative of the compaction values across a worksite; store the ground compaction stress map in a memory; and identify a compaction impact on a subsequent pass of grading from one or more work machines.

7. The ground compaction sensing system of claim 6 wherein the program instructions when executed further causes the processor of the controller to access the ground compaction stress map; modifying movement of one of the grading attachment and an alternative attachment, the alternative attachment coupled to an alternative work machine, based on the compaction impact from the ground compaction stress map.

8. A method of sensing ground compaction from a work machine, the work machine extending in a fore-aft direction, the method comprising:

generating a chassis angle signal from a first sensor coupled to a chassis of the work machine, the chassis angle signal indicative of a chassis angle relative to a direction of gravity;

generating an attachment angle signal from a second sensor coupled to an attachment of the work machine, the attachment angle signal indicative of an attachment angle relative to the direction of gravity;

generating an attachment spacing signal from a third sensor coupled to the work machine wherein a distance between a grading attachment and the chassis is derived;

generating a location signal from a fourth sensor coupled to the work machine, the location signal indicative of one of the chassis and the attachment;

receiving the chassis angle signal from the first sensor by a controller of the work machine;

receiving the attachment angle signal from the second sensor by the controller;

receiving the attachment spacing signal from the third sensor by the controller;

receiving the location signal from the fourth sensor by the controller;

determining an as-built grade of a surface based on an attachment reference at a first location of the location signal;

determining a compaction value of the as-built surface based in the chassis angle signal, the attachment angle signal, the attachment spacing signal, and the location signal when a chassis reference point reaches the first location as the work machine traverses across the surface wherein the compaction value is an elevational difference of the as-built surface and the as-built surface compacted by the ground-engaging mechanism; and modifying movement of the work machine based on the compaction value.

9. The method of sensing ground compaction of claim 8 wherein the chassis reference point is located on one of an aft portion of the chassis and behind the ground-engaging mechanism.

10. The method of sensing ground compaction of claim 8 further comprising controlling a display device to display one of the compaction value and the elevational difference in real-time as a singular graphic with a compacted surface overlayed with the as-built surface.

11. The method of sensing ground compaction of claim 8 further comprising communicating the compaction value to a follower work machine wherein the follower work machine modifies a ground-engaging attachment coupled to the follower work machine in response to receiving the compaction value.

12. The method of sensing ground compaction of claim 8 wherein the modifying movement of the grading attachment comprises adjusting a pitch of the grading attachment to reflect a desired grade.

13. The method of sensing ground compaction of claim 8 further comprising generating a ground compaction stress map indicative of the compaction values across a worksite; store the ground compaction stress map in a memory; and identify a compaction impact on a subsequent pass of grading from one or more work machines.

14. The method of sensing grade of claim 13 further comprising accessing the ground compaction stress map; modifying movement of one of the grading attachment and an alternative attachment, the alternative attachment coupled to an alternative work machine, based on the compaction impact of a location from the ground compaction stress map.

* * * * *